US005653648A

United States Patent [19]

Thurman

[11] Patent Number: 5,653,648

[45] Date of Patent: Aug. 5, 1997

[54] GOLF BALL WITH ELLIPTICAL CROSS-SECTION DIMPLES

[75] Inventor: Robert T. Thurman, Humboldt, Tenn.

[73] Assignee: Wilson Sporting Goods Co., Chicago, Ill.

[21] Appl. No.: 678,504

[22] Filed: Jul. 9, 1996

[51] Int. Cl.[6] ..... A63B 37/14

[52] U.S. Cl. ..... 473/384

[58] Field of Search ..... 473/383, 384; 273/232

[56] References Cited

U.S. PATENT DOCUMENTS

| | | | |
|---|---|---|---|
| 4,560,168 | 12/1985 | Aoyama . | |
| 4,869,512 | 9/1989 | Nomura et al. | 473/383 |
| 4,880,241 | 11/1989 | Melvin . | |
| 4,979,747 | 12/1990 | Jonkouski . | |
| 5,016,887 | 5/1991 | Jonkouski . | |
| 5,158,300 | 10/1992 | Aoyama . | |
| 5,314,187 | 5/1994 | Proudfit . | |
| 5,415,410 | 5/1995 | Aoyama . | |
| 5,470,076 | 11/1995 | Cadorniga . | |

*Primary Examiner*—George J. Marlo

[57] ABSTRACT

1. A golf ball having a generally spherical outer surface and a center, the outer surface being provided with a plurality of dimples, at least some of the dimples having a surface with an elliptical cross section which is a portion of an ellipse defined by the equation:

$$X^2/A^2+(Y-k)^2/B^2=1$$

where X is a coordinate on an X axis which extends perpendicularly to a radial line from the center of the ball to the center of the ellipse, Y is a coordinate on a Y axis which is aligned with said radial line, A is one-half of the major axis of the ellipse which is aligned with said X axis, B is one-half of the minor axis of the ellipse which is aligned with said Y axis, and K is the distance along the Y axis between the center of the ellipse and the center of the golf ball.

7 Claims, 8 Drawing Sheets

GOLF BALL WITH ELLIPTICAL CROSS-SECTION DIMPLES

BACKGROUND

This invention relates to golf balls, and more particularly, to a golf ball with dimples having an elliptical cross section.

In the past, many different designs of dimple cross sectional geometry have been utilized in an attempt to achieve optimum aerodynamic performance of a golf ball. Most of these designs were developed using a single radius to produce the cross sectional geometry desired. The cross section of a single radius dimple is an arc of a circle. From these single radius designs, a search for optimum aerodynamic performance was constrained to one or more of the following three variables: dimple depth, dimple volume, and dimple aspect ratio (dimple depth/dimple diameter). None of these schemes takes into consideration the edge break angle between the tangent line to the ball radius and the tangent to the dimple curve at the point where the ball radius and dimple curve intersect. This break angle is crucial in dictating the aerodynamic performance of the golf ball.

SUMMARY OF THE INVENTION

In order to incorporate the break angle as a design variable, a more flexible approach would be required in generating the geometry than the single radius methodology. By defining the dimple cross sectional geometry with an ellipse, it becomes possible to include the break angle as a fourth design variable while controlling dimple depth, dimple volume, and dimple aspect ratio variables as well. Using a robust design of experiment, an elliptical cross sectional dimple design can be found that optimizes the aerodynamic performance of the golf ball.

DESCRIPTION OF THE DRAWING

The invention will be explained in conjunction with illustrative embodiments shown in the accompanying drawings, in which.

DESCRIPTION OF SPECIFIC EMBODIMENTS

Figure 1:
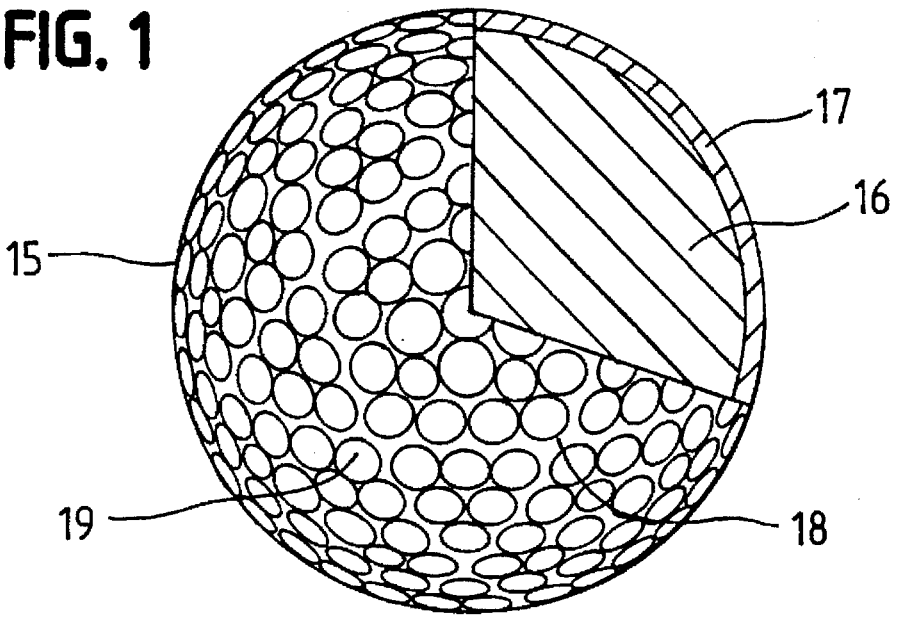
FIG. 1 illustrates a golf ball, partially broken away, formed in accordance with the invention.
Figure 2:
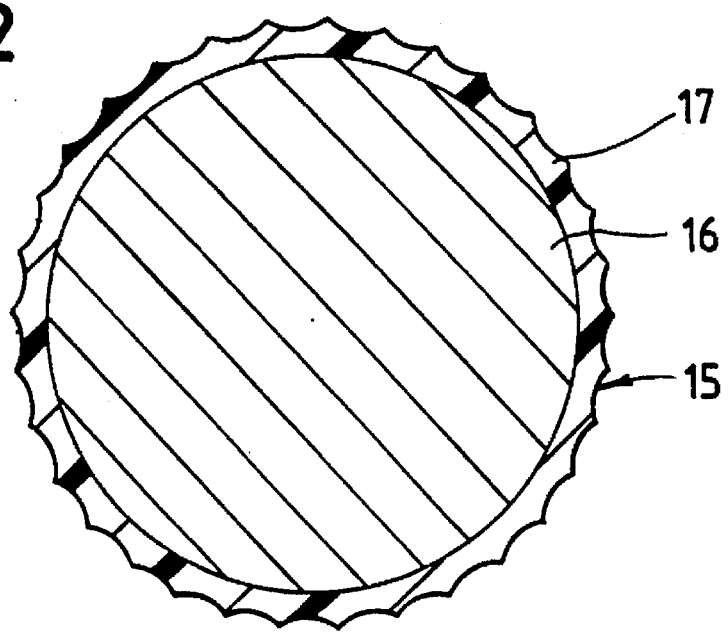
FIG. 2 is a cross sectional view of the golf ball of FIG. 1.

FIGS. 1 and 2 illustrate a two-piece golf ball 15 which includes a solid core 16 and a cover 17. Both the core and the cover can be formed form conventional materials. For example, the cover can be formed from ionomer resins, other thermoplastic or polymeric resins, or natural or synthetic balata. The golf ball cover has an outer spherical surface 18 which is provided with a plurality of dimples or recesses 19.

Figure 3:
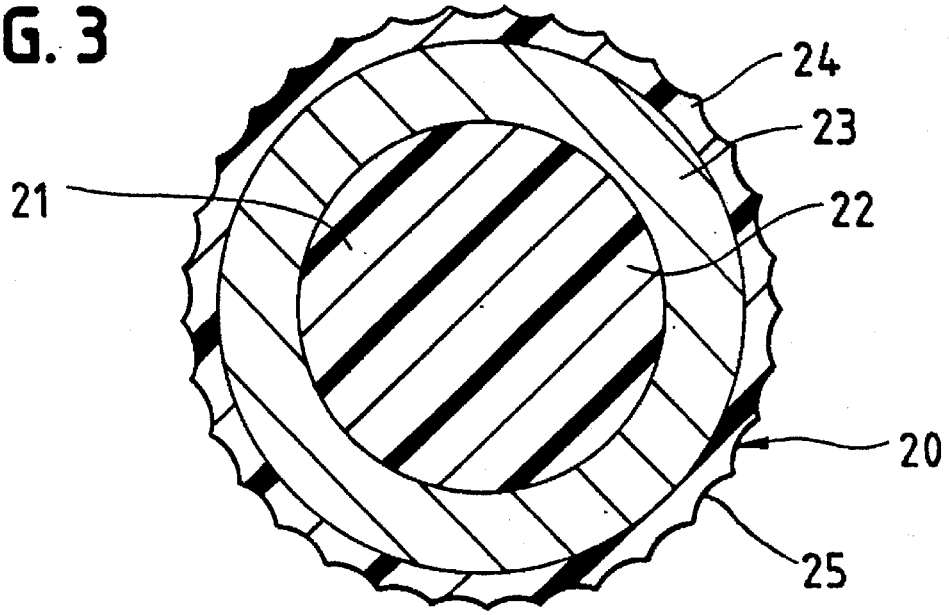
FIG. 3 is a cross sectional view similar to FIG. 2 showing an alternative construction of the golf ball.

FIG. 3 illustrates a three-piece golf ball 20 which includes wound core 21 which comprises a center 22 and a layer 23 of windings of elastic thread. The center may be solid or a liquid filled balloon. Such wound cores are also conventional. The ball 20 includes a cover 24, which may be constructed in the same way as the cover 17. The cover is provided with a plurality of dimples 25.

Figure 4:
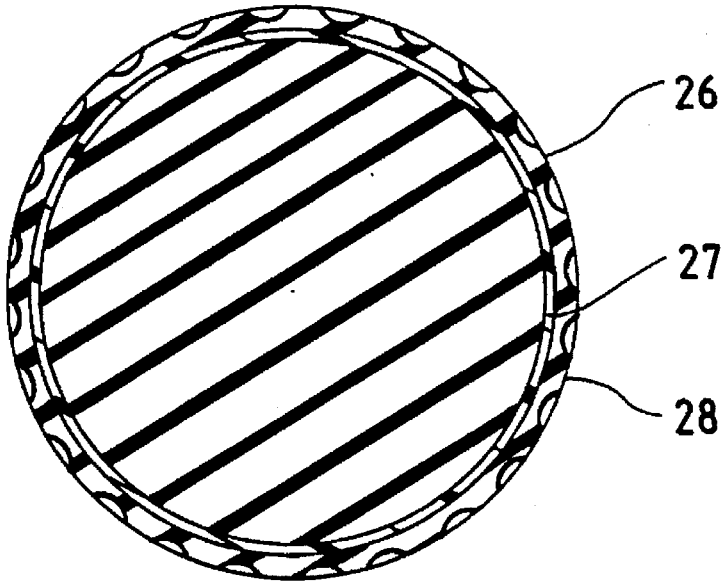
FIG. 4 is a cross sectional view similar to FIGS. 2 and 3 showing an alternative construction of the cover of the golf ball.

The cover of the two-piece and three-piece balls can be formed from a single layer as illustrated in FIGS. 2 and 3, or can be formed from multiple layers of polymeric materials and/or balata as described in U.S. Pat. No. 5,314,187 and as illustrated in FIG. 4. The cover 26 includes an inner layer 27 of ionomer or other polymeric material and an outer layer 28 of natural or synthetic balata, ionomer, or other polymeric material.

The invention may also be used with solid golf balls which do not have a separate core and a separate cover.

The dimples may be formed in any pattern desired. For example, the dimple patterns described in my co-pending U.S. Patent Application entitled, "Geodesic Icosahedral Golf Ball Dimple Pattern," Ser. No. 08/301,245 filed Sep. 6, 1994, which is incorporated herein by reference, or in U.S. Pat. No. 4,560,168 may be used. Also, the number and sizes of the dimples may be varied. Although elliptical dimples as described herein have various advantages over dimples of other shapes, it is not necessary that all of the dimples of a particular golf ball be elliptical. For example, some of the dimples could have other cross sectional shapes, such as circular, truncated cone, etc.

Figure 5:
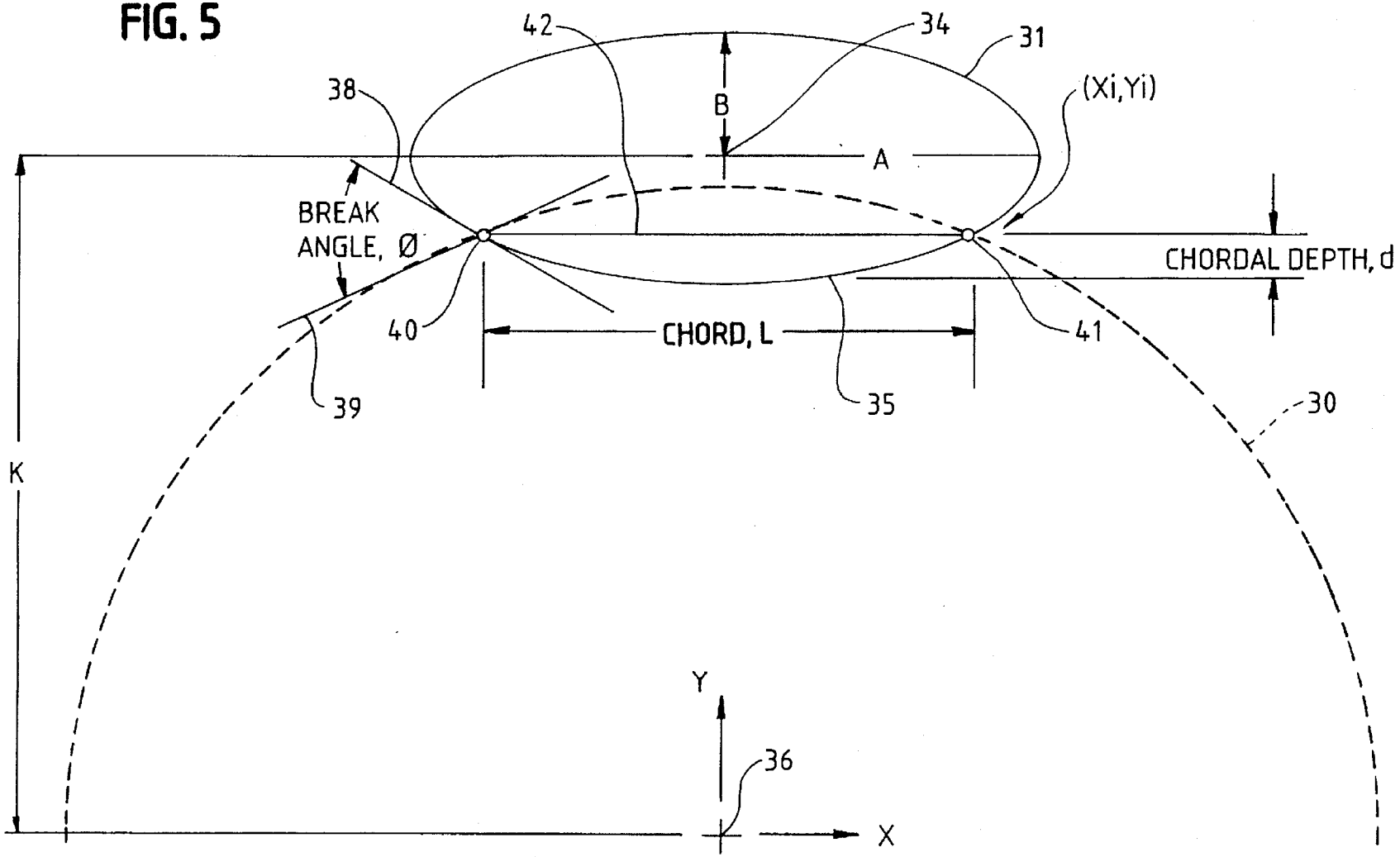
FIG. 5 illustrates the manner of forming an elliptical dimple in a golf ball.
Figure 6:
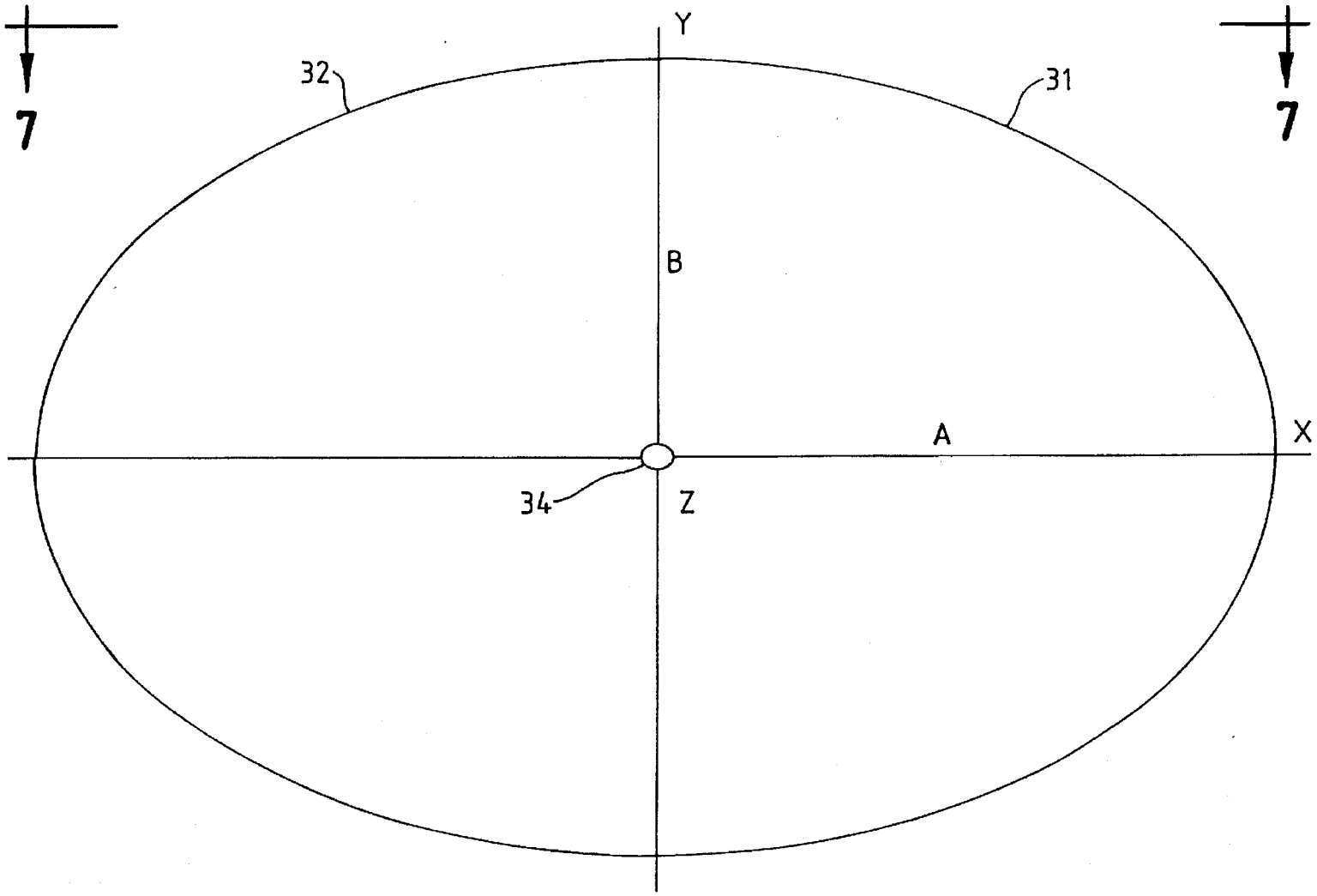
FIG. 6 is a side elevational view of an ellipsoid or oblate spheroid which is used to form the elliptical dimple.
Figure 7:
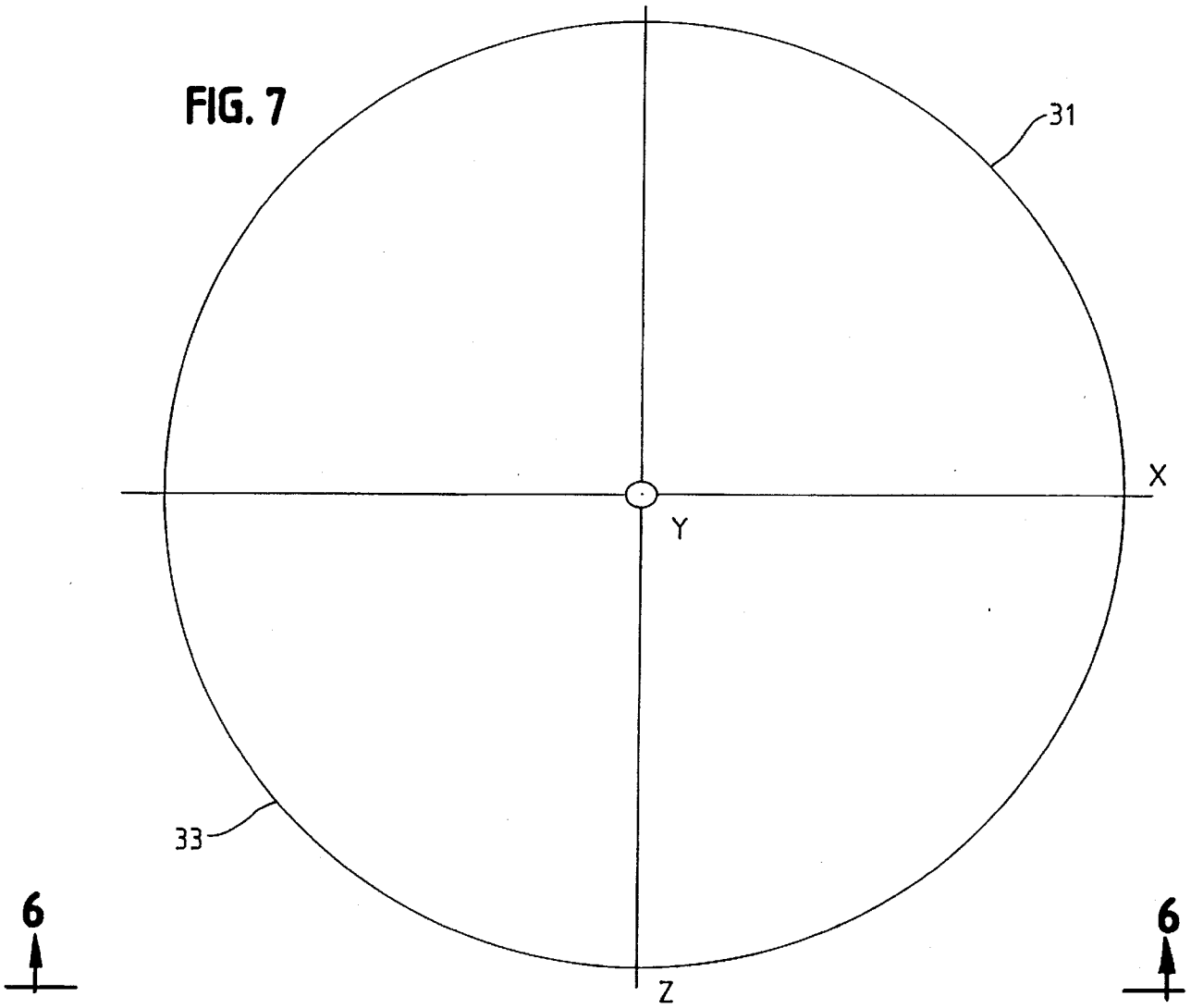
FIG. 7 is a top plan view of the ellipsoid or oblate spheroid of FIG. 5.

FIG. 5 illustrates how an elliptical dimple, i.e., a dimple having a cross section which is a portion of an ellipse, can be generated. The spherical surface of a golf ball is represented by the dashed line 30. An ellipsoid or oblate spheroid 31 is a geometric solid having an elliptical cross section in planes which are parallel to the plane of FIG. 5. The ellipsoid 31 is also illustrated in FIGS. 6 and 7. The ellipsoid is shaped like a flying saucer and has a surface of revolution which is generated by rotating an elliptical curve 32 about a vertical Y axis. Cross sections of the ellipsoid which lie in planes which are parallel to the plane formed by the X and Y axes are elliptical.

FIG. 7 is a top plan view of the ellipsoid 31, which has a circular outer periphery 33. Cross sections of the ellipsoid which are parallel to the plane formed by the X and Z axes are circular.

The ellipsoid illustrated in FIG. 6 has a major axis 2A along the X axis and a minor axis 2B along the Y axis. The major and minor axes intersect at the center 34 of the ellipsoid which is defined by the intersections of the X, Y, Z axes.

Referring again to FIG. 5, dimple surface 35 is formed by a portion of the surface of the ellipsoid 31. The depth to which the surface of the ellipsoid projects into the spherical surface 30 of the ball is determined by the distance K between the center 36 of the spherical surface 30 of the golf ball and the center 34 of the ellipsoid.

The dimple edge break angle $\phi$ is the included angle between a tangent line 38 which is tangent to the ellipsoid at the point at which the ellipsoid intersects the spherical surface 30 and a tangent line 39 which is tangent to the spherical surface 30 at the point of intersection between the ellipsoid and the spherical surface. The chord length L of the dimple is the distance between points 40 and 41 illustrated in FIG. 5. The chordal depth d is the distance along the Y axis between the chord line 42 and the bottom of the dimple. The chord line 42 lies in a chordal plane which extends through the points of intersection between the ellipsoid and the spherical surface 30.

In FIG. 5 the edge break point between the dimple surface 35 and the spherical surface 30 which defines the chord line 42 is represented by the coordinates $X_1$ and $Y_1$ relative to the X and Y axes of the ellipsoid 31.

By defining the dimple cross sectional geometry with an ellipse, it is possible to include the break angle $\phi$ as a design variable in optimizing dimple design. An ellipse is defined by the following equations:

$$\frac{X^2}{A^2}+\frac{(Y-K)^2}{B^2}=1 \qquad \text{Equation 1:}$$

$$Y=K\pm\left(\frac{B}{A}\right)\sqrt{A^2-X^2} \qquad \text{Equation 2:}$$

where A is the one-half of the major axis and B is one-half of the minor axis of the ellipse, K is the distance along the Y axis between the center of the spherical surface of the golf ball and the center of the ellipse as illustrated in FIG. 5.

However, designing dimple geometry using A, B and K as design variables is somewhat difficult. It is easier to use more familiar terms such as dimple edge break angle $\phi$ and dimple chordal depth d. Knowing that the equation of the spherical surface of the ball is:

$$X^2+Y^2=R^2$$

where R is the radius of the sphere, the following equations can be generated to find K, B, and A using only the dimple edge break angle $\phi$ and the dimple chordal depth d as variables:

$$K=f(\phi,d)=\frac{X_iY_i\left[\dfrac{\frac{X_i}{Y_i}-\tan\phi}{\frac{X_i}{Y_i}\tan\phi+1}\right]+d(2Y_i-d)}{2d+X_i\left[\dfrac{\frac{X_i}{Y_i}-\tan\phi}{\frac{X_i}{Y_i}\tan\phi+1}\right]} \qquad \text{Equation 3:}$$

$$B=d-Y_i+K \qquad \text{Equation 4:}$$

$$A=\sqrt{\frac{X_i^2}{\left(1-\left[\frac{(Y_i-K)^2}{B^2}\right]\right)}} \qquad \text{Equation 5:}$$

$X_i$ and $Y_i$ are the coordinates of the edge break points 38 and 39 as previously described.

Figure 8:
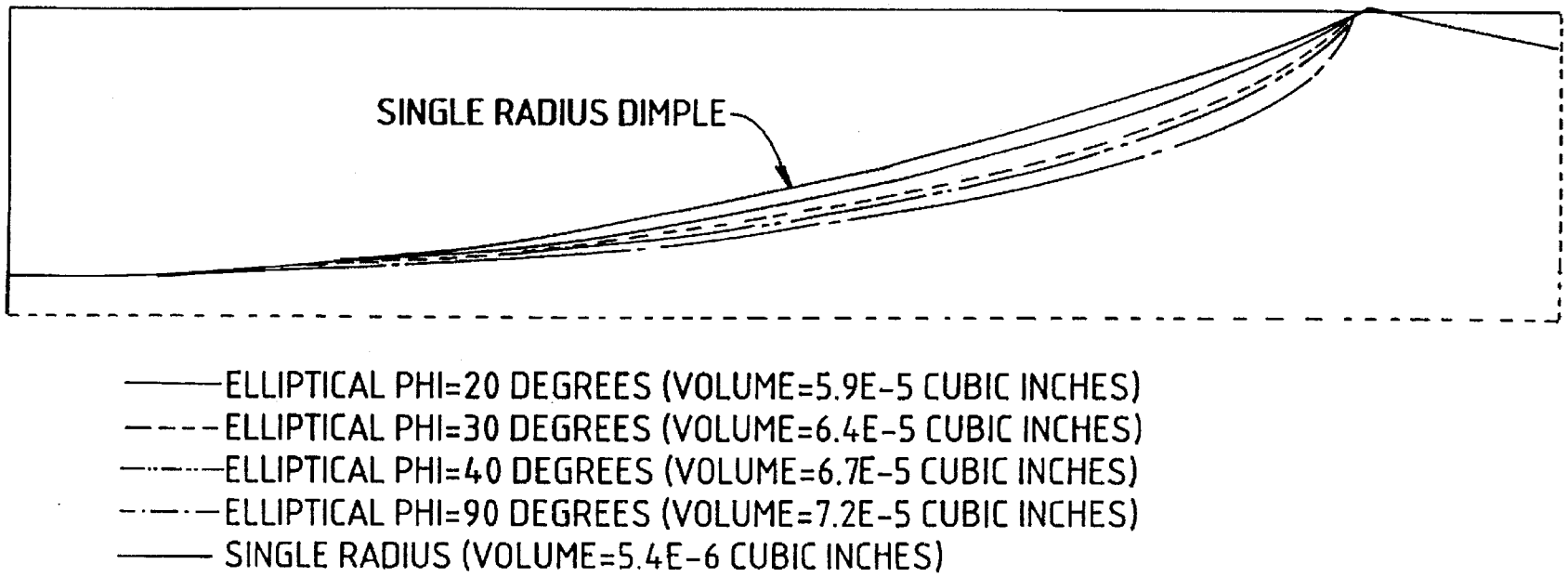
FIG. 8 illustrates the cross sectional shapes of various elliptical dimples compared to a circular dimple.

FIG. 8 shows that dimples having an elliptical cross section provide more dimple volume than a dimple having a circular cross section at no additional dimple depth (or at the same aspect ratio). The top solid line represents a circular dimple having a single radius. The volume of the dimple is $5.4\times10^{-6}$ cubic inches. The second solid line represents an elliptical dimple having a break angle of 20 degrees and a volume of $5.9\times10^{-5}$ cubic inches. The next dashed line represents an elliptical dimple having a break angle of 30 degrees and a volume of $6.4\times10^{-5}$ cubic inches. The dotted line represents an elliptical dimple having a break angle of 40 degrees and a volume of $6.7\times10^{-5}$ cubic inches. The dot dash line represents an elliptical dimple having a break angle of 90 degrees and a volume of $7.2\times10^{-5}$ cubic inches.

Figure 9:
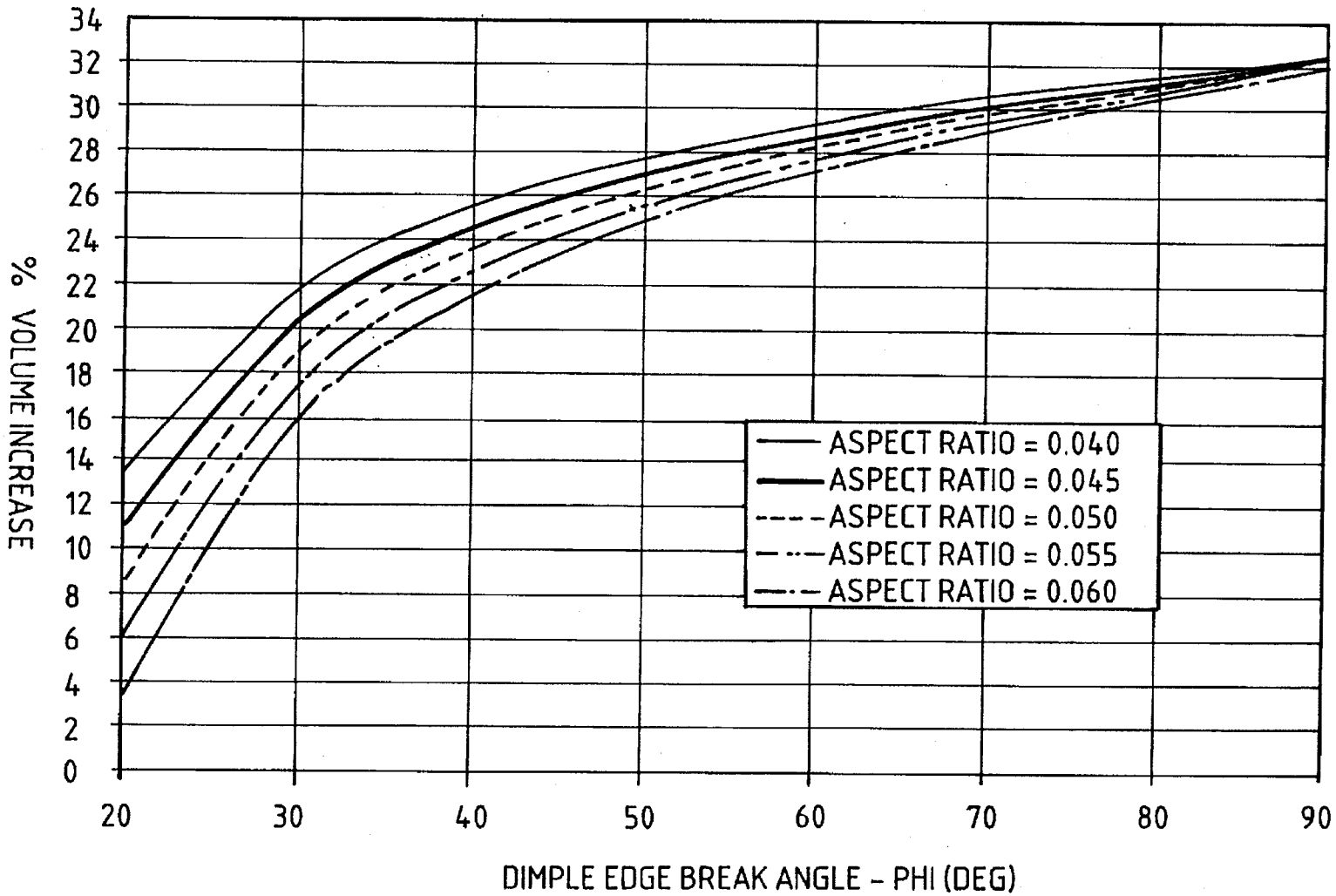
FIG. 9 illustrates how much of an increase in volume is provided by an elliptical dimple over that of a single radius dimple for equivalent dimple chord and dimple chordal depths.

FIG. 9 illustrates how much of an increase in volume is provided by an elliptical dimple over that of a circular or single radius simple for equivalent dimple chord and dimple chordal depths.

Figure 10:
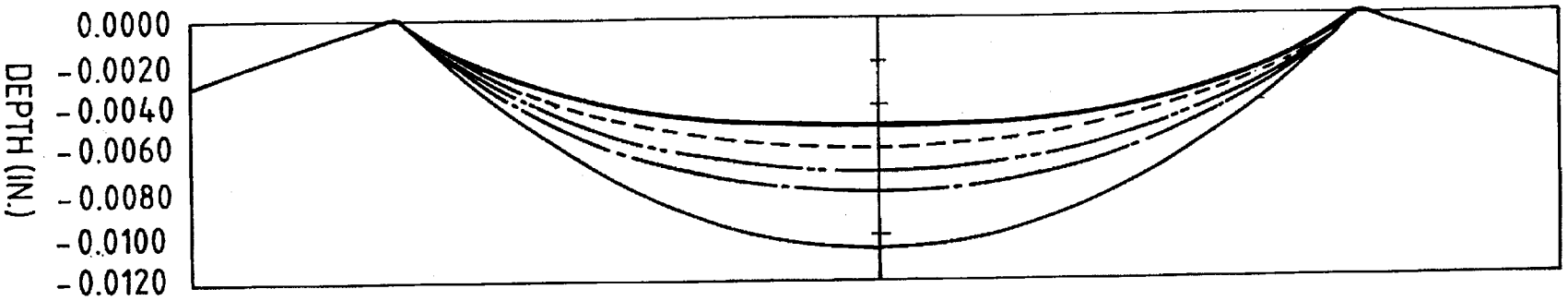
FIG. 10 illustrates how elliptical dimples can be produced with a dimple edge break angle which is equivalent to that of a circular dimple but at much shallower depths.

FIG. 10 shows that elliptical dimples can be produced with equivalent dimple edge break angles to that of a circular or singular radius dimple, but at a much shallower depths.

The dimple edge break angles for elliptical dimples formed in accordance with the invention may vary from about 18° to about 90°. Best performance results from dimples having edge break angles in the range of 20° to 30° and chordal depths in the range of 0.004 to 0.008 inch. The dimples are preferably arranged in an icosahedral pattern as described in U.S. Pat. No. 4,560,168 or in a geodesically expanded icosahedral pattern as described in the aforementioned U.S. patent application Ser. No. 08/301,245. The number of dimples can range from 330 to 512. The dimple sizes can range from 1 to 7, and the dimples can cover from about 65% to about 85% of the spherical surface of the golf ball.

The foregoing description enables a designer to vary the break angle, dimple depth, dimple volume, and dimple aspect ratio in order to determine the aerodynamic performance which best suits his objectives.

While in the foregoing specification a detailed description of specific embodiments of the invention was set forth for the purpose of illustration, it will be understood that many of the details herein given may be varied considerably by those skilled in the art without departing from the spirit and scope of the invention.

We claim:

1. A golf ball having a generally spherical outer surface and a center, the outer surface being provided with a plurality of dimples, at least some of the dimples having a surface with an elliptical cross section which is a portion of an ellipse defined by the equation:

$$X^2/A^2+(Y-K)^2/B^2=1$$

where X is a coordinate on an X axis which extends perpendicularly to a radial line from the center of the ball to the center of the ellipse, Y is a coordinate on a Y axis which is aligned with said radial line, A is one-half of the major axis of the ellipse which is aligned with said X axis, B is one-half of the minor axis of the ellipse which is aligned with said Y axis, and K is the distance along the Y axis between the center of the ellipse and the center of the golf ball.

2. The golf ball of claim 1 in which the periphery of the dimples which is formed by the intersection of the dimple surface and the spherical surface of the ball is generally circular.

3. A golf ball having a generally spherical outer surface and a center, the outer surface being provided with a plurality of dimples, at least some of the dimples having a surface with an elliptical cross section which is a portion of an ellipse having a major axis and a minor axis, each of said elliptical dimples having a dimple edge break angle $\phi$ which is the included angle between a first tangent to the dimple surface at the outer surface of the ball and a second tangent to the outer surface of the ball at the intersection of said first tangent and the outer surface of the ball, each of said elliptical dimples having a dimple chordal depth d which is the distance between the bottom of the dimple and a chordal plane which extends through the points of intersection between the dimple surface and the outer surface of the ball, the center of the ellipse of each dimple being defined by the equation:

$$K = f(\phi, d) = \frac{X_i Y_i \left[ \dfrac{\dfrac{X_i}{Y_i} - \tan\phi}{\dfrac{X_i}{Y_i} \tan\phi + 1} \right] + d(2Y_i - d)}{2d + X_i \left[ \dfrac{\dfrac{X_i}{Y_i} - \tan\phi}{\dfrac{X_i}{Y_i} \tan\phi + 1} \right]}$$

where K is the distance from the center of the ball to the center of the ellipse, $X_i$ is a coordinate on an X axis which is aligned with said major axis of the ellipse and which extends perpendicularly to a radial line from the center of the ball to the center of the ellipse and $Y_i$ is a coordinate on a Y axis which is aligned with said minor axis of the ellipse and said radial line and $X_i$ and $Y_i$ are the coordinates of the intersection between the dimple surface and the spherical surface of the ball.

4. The golf ball of claim 3 in which the periphery of the dimples which is formed by the intersection of the dimple surface and the spherical surface of the ball is generally circular.

5. The golf ball of claim 3 in which the dimple edge break angle $\phi$ is within the range of about 20 degrees to about 30 degrees.

6. The golf ball of claim 3 in which said elliptical dimples comprise all of the dimples of the golf ball and the number of dimples is within the range of about 332 about 512.

7. The golf ball of claim 3 in which the dimples comprise about 65 to about 85 percent of the spherical surface of the golf ball.

* * * * *